United States Patent [19]

Lovell

[11] 4,249,408

[45] Feb. 10, 1981

[54] PROCESS FOR EXTRUDING MARAGING STEEL

[76] Inventor: Robert Lovell, 224 Burning Tree Dr., Naples, Fla. 39940

[21] Appl. No.: 923,798

[22] Filed: Jul. 12, 1978

Related U.S. Application Data

[63] Continuation-in-part of Ser. No. 747,494, Dec. 6, 1976, abandoned.

[51] Int. Cl.[3] ..... B21C 23/00; B21C 23/03; B21C 23/18; B21C 25/00

[52] U.S. Cl. ..... 72/256; 72/267; 72/348; 72/349; 72/700; 29/1.2; 72/476

[58] Field of Search ..... 75/123 K; 72/264, 266, 72/267, 347, 348, 349, 356, 352, 253, 700; 29/1.11, 1.2, 1.21, 1.22; 102/43 R

[56] References Cited

U.S. PATENT DOCUMENTS

| | | | |
|---|---|---|---|
| 1,358,199 | 11/1920 | Hadfield | 72/359 X |
| 2,251,094 | 7/1941 | Witter | 72/267 |
| 2,569,248 | 9/1951 | Miller | 72/377 |
| 2,874,460 | 2/1959 | Riethmuller et al. | 72/254 |
| 2,891,298 | 6/1959 | Kaul | 72/267 |
| 2,930,483 | 3/1960 | Kaul | 72/267 |
| 3,108,502 | 10/1963 | Chatfield | 72/354 |
| 3,186,209 | 6/1965 | Friedman | 72/356 X |
| 3,294,527 | 12/1966 | Floreen et al. | 75/123 K |
| 3,584,373 | 6/1971 | Schane | 29/557 |
| 3,594,882 | 7/1971 | Lovell | 29/1.2 |
| 3,927,449 | 12/1975 | Gibble et al. | 72/267 |
| 3,998,087 | 12/1976 | Schumacher et al. | 72/349 |

FOREIGN PATENT DOCUMENTS

| | | | |
|---|---|---|---|
| 255848 | 7/1963 | Australia | 75/123 K |
| 662352 | 4/1963 | Canada | 72/260 |
| 2000352 | 7/1971 | Fed. Rep. of Germany | 72/356 |
| 2107962 | 8/1972 | Fed. Rep. of Germany | 72/266 |
| 572292 | 5/1958 | Italy | 29/1.21 |
| 1288744 | 9/1972 | United Kingdom | 75/123 K |

OTHER PUBLICATIONS

*Nickel Topics,* Published by International Nickel, vol. 22, No. 1, pp. 6 and 7, (1969), "For Unusual Strength and Toughness . . . Maraging Steel".

*The Iron Age,* "Cold Extrusion of Steel", by Lloyd and Kopecki, Aug. 4, 1949, pp. 90–105.

Metals Handbook–Forming, vol. 4, 8th ed. by American Society of Metals (1969), pp. 475–480, "Cold Extrusion".

Metals Handbook–Forging and Casting, 8th ed., vol. 5, by American Society of Metals (19) "High Energy--Rate Forging (HERF)", pp. 99–104.

*Metal Science and Heat Treatment,* vol. 17, Nos. 9–10, Sep.–Oct. 1975, pp. 741–744, "Effect of Preliminary Cold Plastic Deformation on the Properties of Maraging Steels".

*Primary Examiner*—Lowell A. Larson

*Attorney, Agent, or Firm*—McGlynn and Milton

[57] ABSTRACT

This invention provides a method for cold extruding 18% nickel maraging steel to form an article of manufacture, such as a sub projectile blank for the manufacture of cannon rounds which includes performing a series of cold extrusion operations on an extrusion blank with a tapered punch to produce a combination forward extrusion and backward extrusion. On the first cold extrusion operation a tapered hole is formed in the extrusion blank and the extrusion blank is elongated. Subsequent cold extrusion operations progressively elongate both the extrusion blank and the tapered hole. The punch and die geometry are such that the tapered hole is elongated by penetration of the punch into the blank and additionally backward extrusion of the material around the punch. Additionally, as the tapered hole becomes increasingly longer, a floating punch is employed wherein at least a portion of the punch is supported by the walls of the tapered hole.

20 Claims, 15 Drawing Figures

PROCESS FOR EXTRUDING MARAGING STEEL

This is a Continuation-in-Part of Ser. No. 747,494 filed Dec. 6, 1976, now abandoned.

FIELD OF THE INVENTION

This invention relates to a method of forming an article of manufacture by cold extruding material having a tensile strength in excess of 200 ksi and is specifically directed to a method of cold extruding maraging steel containing at least about 18% nickel.

BACKGROUND OF THE INVENTION

This invention provides a method of cold extruding maraging steel by impact extrusion to form an article of manufacture. As used herein, the term "maraging steel" refers to a family of low-carbon, high-nickel, iron base alloys which typically contain about 18% nickel. Due to the high yield strength which can be developed in these materials, 18% nickel maraging steels have been specified for use in making sub projectile blanks for antitank cannon rounds. The sub projectile blank forms a critical part of the cannon round assembly because it is the carrier for a penetrator. The sub projectile blank has a cylindrical shape and is approximately thirteen inches long. The blank also includes a longitudinally extending, tapered hole which is approximately eleven inches long and, hence, extends almost the entire length of the blank. The tapered hole must be precisely located and have extremely close tolerances. The precise dimensions of the tapered hole are necessary for subsequent assembly procedures.

Heretofore, the blank has been machined from bar stock. Due to the toughness of maraging steel, machining is relatively difficult and time-consuming. Additionally, it is very difficult to maintain the close tolerances in the tapered hole which are required. Machining tends to produce surface stresses which promote stress-corrosion cracking in the final assembly. Machining also produces scrap in the form of chips. In machining the sub projectile blank approximately three pounds of scrap is produced. Since the current price for this material is approximately four dollars per pound, the elimination of scrap is economically significant.

In order to eliminate many of these problems and to reduce the cost of producing sub projectile blanks, efforts have been made to employ impact extrusion techniques to form the blanks. Up until now, however, attempts to cold extrude 18% nickel maraging steel in this fashion have been unsuccessful. All previous known attempts to impact extrude sub projectile blanks from 18% nickel maraging steel have resulted in tool breakage.

BRIEF DESCRIPTION OF THE INVENTION

This invention provides a method for successfully cold extruding 18% nickel maraging steel by impact extrusion to form an article of manufacture, such as a sub projectile blank for the manufacture of cannon rounds. The ability to successfully impact extrude 18% nickel maraging steel offers significant savings in the manufacture of sub projectile blanks since a large amount of machining can be eliminated. A reduction in machining not only offers a savings in time, but also in material costs since the amount of scrap generated is reduced. Cold extruding the sub projectile blank in the manner disclosed produces an extremely accurate shape. Moreover, the physical properties of the sub projectile blank are increased about 30% over that of the "machined from bar" blank due to the increase in the mechanical properties of the steel which is induced by cold working.

Basically, the method of the instant invention comprises performing a series of cold extrusion operations on an extrusion blank with a tapered punch to produce a combination forward extrusion and backward extrusion. On the first cold extrusion operation a tapered hole is formed in the extrusion blank and the extrusion blank is elongated. Subsequent cold extrusion operations progressively elongate both the extrusion blank and the tapered hole. The punch and die geometry are such that the tapered hole is elongated by penetration of the punch into the blank and additionally backward extrusion of the material around the punch.

In order to form the long tapered hole in the sub projectile blank and to maintain the required dimensional accuracy, an intermediate machining operation may be performed to elongate the hole in the extrusion blank. More specifically, preliminary cold extrusion is performed by two extrusion operations with a rigidly supported tapered punch to initially form the tapered hole and to produce the required external shape in the blank. In these preliminary cold extrusion operations the blank is not moved completely through the extrusion die, but is restrained to cause a significant amount of backward extrusion. In subsequent cold extrusion operations, the blank is moved entirely through an extrusion die. Since the blank is being progressively elongated, the length of the tapered punch must necessarily be increased on each extrusion operation, up to a length of sixteen inches. In order to prevent breakage of such long and relatively thin-sectioned tapered punches, provision is made to support at least a portion of the length of the punch by the tapered hole in the blank. Additionally, the punch is supported so that it can float a full three hundred sixty degrees. In the event of slight misalignment between the punch and the tapered hole, the floating punch is capable of automatically centering itself. In view of the length and cross-sectional size of the punches employed in the subsequent cold extrusion operations, the slightest amount of misalignment would cause instant breakage of a rigid punch. Not only does the floating punch prevent breakage, but it also facilitates correction of any eccentricity between the O.D. and I.D. of the blank.

In short, the method of the instant invention provides the first successful procedure for cold extruding 18% nickel maraging steel by a method other than drawing, spinning or roll forming. While the invention is directed specifically to solving the problems heretofore encountered in cold extruding 18% nickel maraging steel, and specifically with respect to the manufacture of sub projectile blanks from 18% nickel maraging steel, the principles set forth herein are seen to be applicable to other difficult to extrude materials, that is, those having tensile strengths of 200 ksi and greater.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

As suggested above, this invention provides a method by which 18% nickel maraging steel can be successfully cold extruded by an impact extrusion process to form a relatively complex-shaped article of manufacture, such as a sub projectile blank used in the assembly of antitank cannon rounds. Generally, the method comprises a series of cold extrusion operations which are performed not only for the purpose of developing the specified shape to the required dimensional accuracy, but also to produce a final part having relatively uniform and extensive (approximately 60% reduction in area) cold work throughout to enhance the physical properties of the part.

Figure 11:
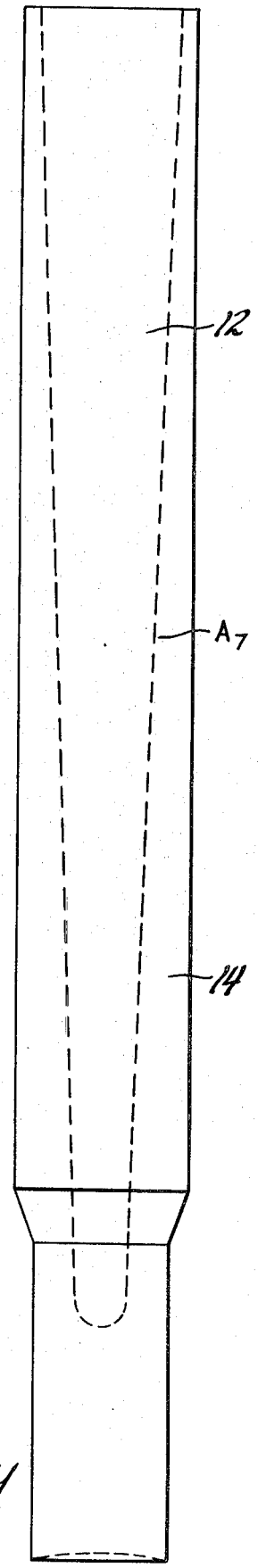
FIG. 11 is a front-elevational view of a final cold extruded article of manufacture produced in accordance with the instant invention.

The object of the cold extrusion procedure is to produce the sub projectile blank $A_7$ in FIG. 11. The article is referred to as a "sub projectile blank" because, as suggested above, it is an article in an intermediate stage of processing. After forming the blank by the method described herein the blank $A_7$ must be externally finish-machined to form the required details. After being machined, the blank $A_7$ becomes part of a projectile assembly. This invention is directed to the solution of the problems encountered in forming the sub projectile blank $A_7$.

One of the most difficult problems encountered in forming the sub projectile blank $A_7$ is presented by the tapered hole 12 which must be accurately located and of extremely close dimensional tolerances. As pointed out above, the equivalent of the blank $A_7$ has, in the past, been produced entirely by machining. Machining is undesirable because it is time-consuming and produces a relatively large amount of scrap in the form of chips. However, up to now, machining has been the only satisfactory method of producing the part. Cold extrusion has not been successful due to the toughness of the material and the shape of the part.

The body 14 of the blank $A_7$ is approximately thirteen inches long and has a maximum diameter of approximately 1.5 inches. The tapered hole 12 is approximately eleven inches long. Hence, the sub projectile blank $A_7$ is essentially a hollow body. Forming a hollow body of this shape by cold extruding 18% nickel maraging steel using standard techniques has heretofore been impossible.

The success of the method of the instant invention in cold extruding 18% nickel maraging steel is attributed, in great part, to the design of the extrusion tools, i.e., the punches and dies. The punches for each of the cold extrusion operations are tapered, that is, they include an elongated nose section having tapered sides terminating in a rounded end. The tapered punches greatly facilitate backward extrusion which is essential to the formation of the tapered hole in the blank. It has been found literally impossible to impact extrude such a hole with a punch having standard backward extrusion punch geometry.

The specific manner of producing the sub projectile blank shown in FIG. 11 is hereinafter described to illustrate the important aspects of the invention.

An extrusion blank $A_1$ is provided by sawing or shearing a section approximately five inches in length from two-inch-diameter bar stock. The length of the extrusion blank $A_1$ is determined precisely in view of the volume of material required to produce the finished sub projectile blank $A_7$ and further in view of any material losses which occur during processing, specifically, during machining. The blank is then furnace or salt bath annealed at 1500° F. for two hours and air cooled.

After annealing the extrusion blank $A_1$ is prepared for extrusion by deburring, cleaning and lubricating as is common practice in the extrusion of steel parts. Cleaning and lubricating is accomplished by conveying the extrusion blank through a series of nine tanks. The first tank contains a primary cleaner made up of a high-alkaline caustic material. After cleaning the extrusion blank is conveyed to a second tank in which it receives a hot water rinse. The extrusion blank is then moved to a third tank which contains a pickling solution.

It is noted that the pickling solution is different from that which is normally used for etching standard steel parts. The pickling solution used to pickle the 18% nickel maraging steel extrusion blank is a solution comprising 10% nitric acid and 3% hydrofluoric acid. This solution sufficiently etches the extrusion blank to insure that the lubricant will take.

After pickling, the extrusion blank is moved to the fourth and fifth tanks in which the extrusion blank receives, in succession, a cold water rinse and a hot water rinse. The extrusion blank is then dipped in a solution in the sixth tank which contains zinc oxide, phosphoric acid and nitric acid. The extrusion blank is then moved to the seventh tank in which it receives a cold water rinse. The eighth tank contains a straight borox solution for neutralizing the extrusion blank. The extrusion part is then lubricated in the ninth tank with a sodium stearate solution.

The extrusion blank is lubricated prior to the first cold extrusion operation and before each successive cold extrusion operation.

Figure 1:
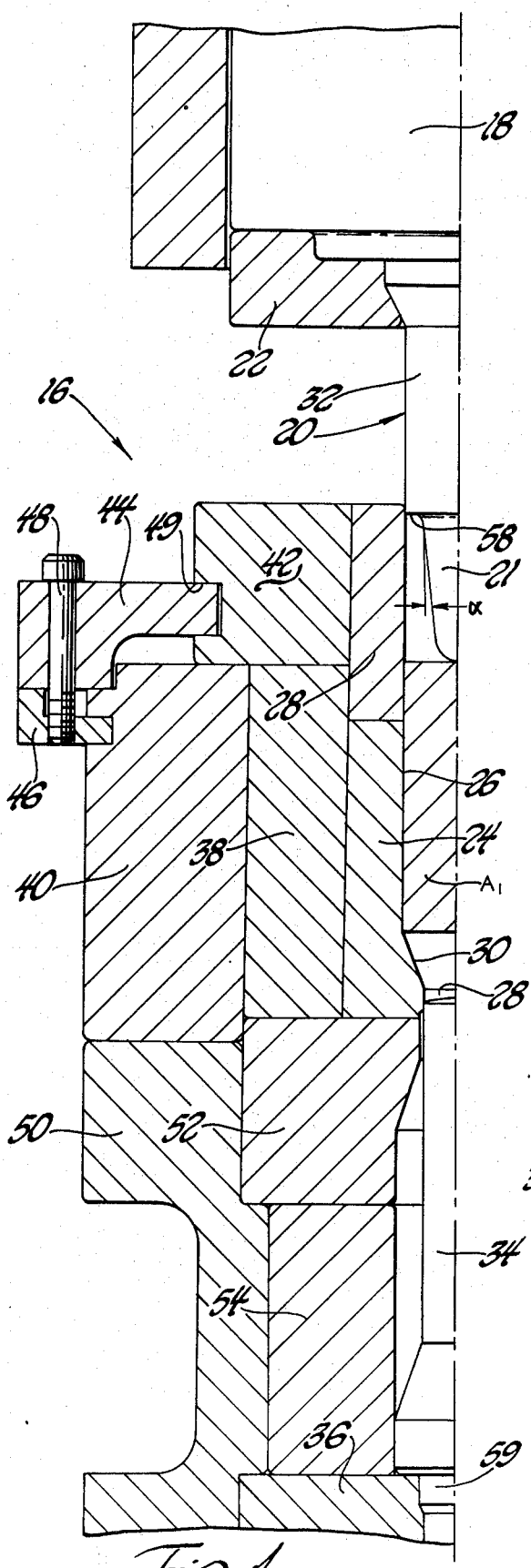
FIG. 1 is a cross-sectional view of an extrusion press and related extrusion tools in accordance with the instant invention for performing a first cold extrusion operation on an extrusion blank.

An extrusion press set up for performing the first cold extrusion operation is shown generally at 16 in FIG. 1. The dies and punches employed are made of high speed steel, such as steels generically of the M4 variety, and/or tungsten carbide. The extrusion press 16 has a capacity of 1300 tons and is of generally standard design. The press 16 includes a vertically movable, hydraulically operated ram 18. An extrusion punch 20 is rigidly attached to the movable ram 18 by a retainer 22. The geometry of the extrusion punch 20 is unique because it includes an elongated, tapered nose 21.

The lubricated extrusion blank $A_1$ is seated in the die cavity of a primary extrusion die 24. The extrusion die 24 includes an upper section having straight walls 26 and a tapered section 30. While a die land 27 is included, it is not employed in the first cold extrusion operation. The height of the die cavity is increased by a secondary extrusion die 28 which is located above and rests on the primary extrusion die 24. The purpose of the secondary extrusion die 28 is to extend the height of the die cavity so that the extrusion blank $A_1$ is completely entered into the die cavity with sufficient die cavity height above the seated blank $A_1$ to allow for entry of the punch shank 32 as will be more clearly described herein.

An anvil 34 is supported below the extrusion die 24 on a lower die plate 36 and extends into the die land 27 to close the end of the tapered section 30. As will be seen the anvil 34 partially restrains the extrusion blank $A_1$.

In accordance with standard extrusion practice the extrusion press 16 includes an inner shrink ring 38 and an outer shrink ring 40 for restraining the extrusion die 24. A shrink ring 42 is also provided for restraining the secondary extrusion die 28. The shrink ring 42 for the secondary extrusion die 28 is held in place by a number of clamps 44 which are pivotally connected to a support ring 46 by means of bolts 48. As shown, the clamps 44 fit into a slot 49 in the shrink ring 42. The dies and shrink rings are supported by a support ring 50, a primary support block 52 and a secondary support block 54.

The extrusion punch 20 employed in the first cold extrusion operation includes a cylindrical shank 32 and an elongated nose 21 having tapered sides and a rounded end. The taper angle $\alpha$ is indicated in FIG. 1. The transition between the nose 21 and the shank 32 of the punch 20 forms a shoulder 58 which limits the amount of backward extrusion which takes place.

When the extrusion blank $A_1$ is properly seated in the die cavity, the ram 18 is motored down until the tapered nose 21 of the punch 20 engages the extrusion blank $A_1$. At this point, the shank 32 of the punch 20 has entered the secondary extrusion die 28. Hence, during extrusion, the shank 32 of the punch 20 is guided in the die cavity over the entire working stroke of the punch 20. Since the punch 20 is rigidly held by the retainer 22 and the punch shank 32 is guided in the die cavity, the hole formed by the nose 21 of the punch 20 can be precisely located. In other words, a very high degree of concentricity is achieved between the I.D. and O.D. of the extruded blank.

Figure 2:
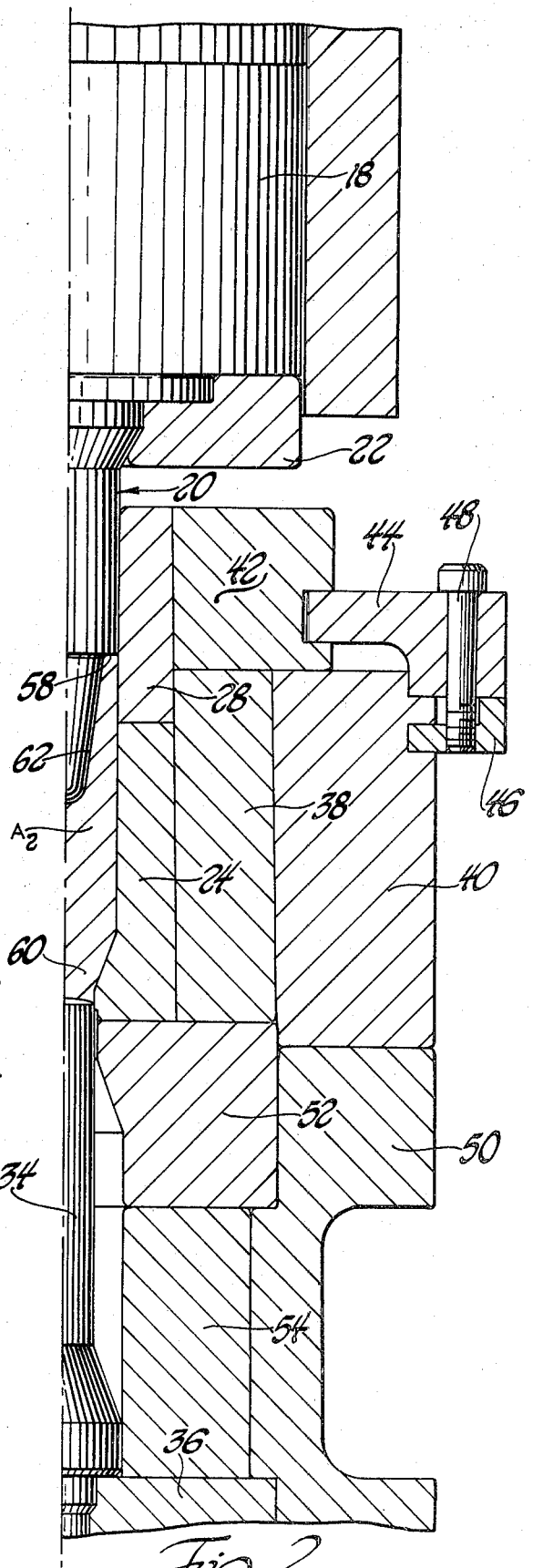
FIG. 2 is a cross-sectional view similar to FIG. 1 showing the moved positions of the various elements after the first extrusion operation is completed.

When the working stroke of the extrusion punch 20 is started, the downward movement of the punch first causes forward extrusion of the blank $A_1$ into the tapered section 30 of the die 24. The forward extrusion forms a conical section 60 on the leading end of the blank $A_1$. Further forward extrusion of the blank is prevented by the anvil 34. Due to the unique geometry of the nose 21 of the punch 20, further downward movement of the punch 20 causes the blank $A_1$ to backward extrude around the nose 21 of the punch until the material reaches the shoulder 58. In this manner, an extremely close tolerance tapered hole having tapered walls 62 is formed in the extrusion blank $A_1$. The location of the various elements of the extrusion press subsequent to the first extrusion operation and the resulting configuration of the extrusion blank $A_2$ is shown in FIG. 2.

Upon completion of the stroke, the extrusion blank $A_2$ is ejected from the die cavity by a knockout 59 which forces the anvil 34 and the extrusion blank $A_2$ upwardly.

The first cold extrusion operation in addition to forming the tapered hole in the extrusion blank $A_2$ has also increased the length of the extrusion blank by approximately one inch. Additionally, a high degree of cold working of the metal is achieved in the region surrounding the tapered hole. The amount of cold work varies from approximately a 15% reduction in area at the bottom of the hole to approximately a 60% reduction in area at the top of the hole. It will be seen that in subsequent cold extrusion operations a primary objective will be to increase the amount of cold work in the blank $A_2$ so that a relatively uniform condition of cold work is achieved throughout the part of about a 60% reduction in area. As noted above, this high degree of cold working in the blank produces an increase in the physical properties of the material by approximately 30% as compared to the equivalent "machined from bar" part. Additionally, the flow pattern achieved by cold extruding is particularly suitable in a part which is intended for use as a penetrator, as is the case with the sub projectile blank.

Figures 3, 4:
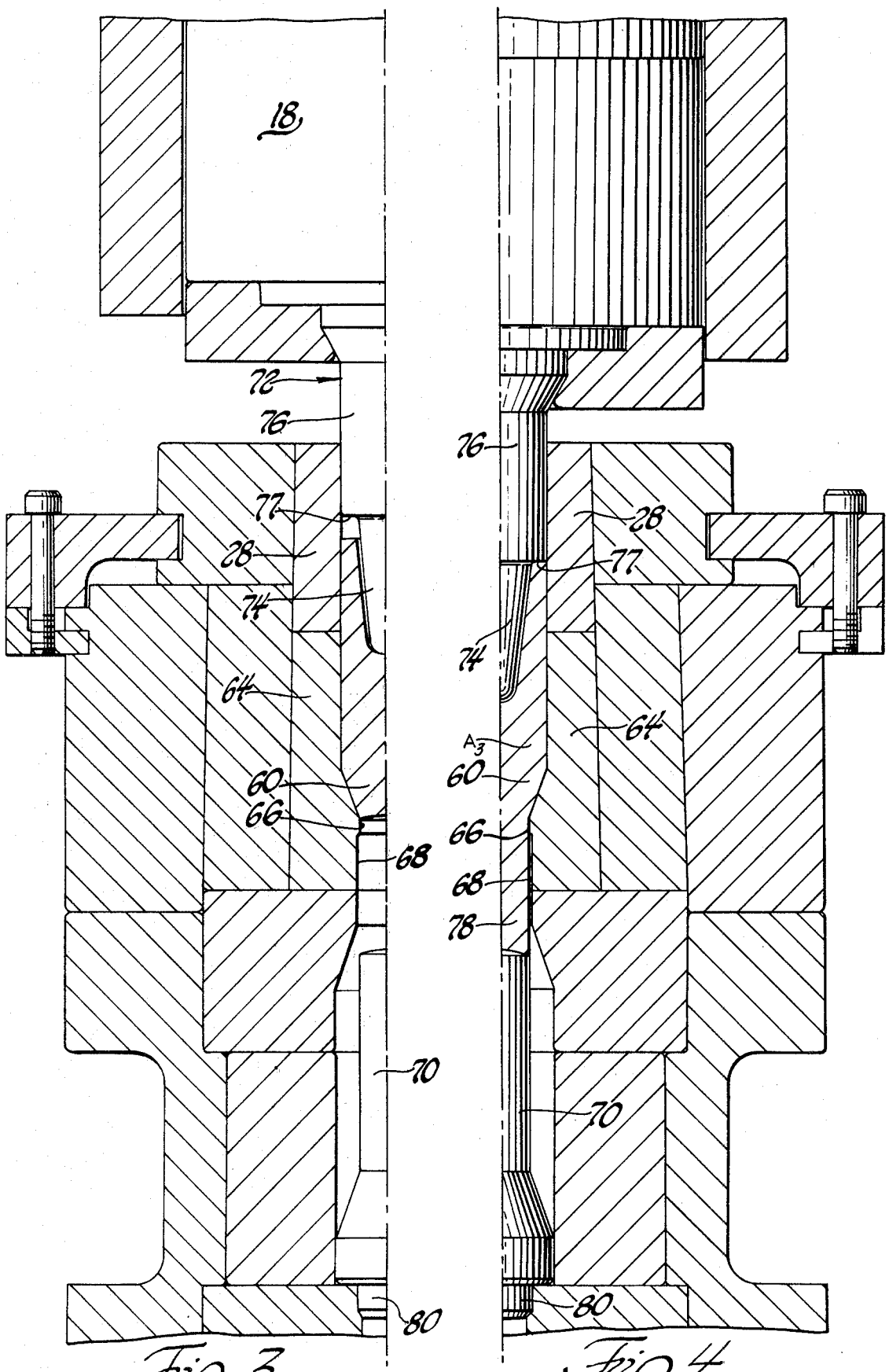
FIG. 3 is a cross-sectional view of an extrusion press and related extrusion tools in accordance with the instant invention for performing a second cold extrusion operation on an extrusion blank.
FIG. 4 is a cross-sectional view similar to FIG. 3 showing the moved positions of the various elements after the second cold extrusion operation is completed.

The second cold extrusion operation is performed in the extrusion press shown in FIGS. 3 and 4. The basic components of the extrusion press shown in FIGS. 3 and 4 are the same as those shown in FIGS. 1 and 2; hence, only those components which are different will be described in detail.

The second extrusion operation is performed with an extrusion die 64 having a die cavity which is dimensionally identical to the die cavity of the extrusion die used in the first cold extrusion operation. Additionally, the extrusion die 64 includes a die land 66 and a relieved section 68 below the die land 66 which forms a clearance. A shorter anvil 70 is used in place of the anvil 34 used in the first extrusion operation to permit a predetermined amount of forward extrusion of the extrusion blank $A_2$ through the die land 66. A second extrusion punch, generally indicated at 72, is mounted in the ram in the same manner as described for the first extrusion operation. The tapered nose 74 of the second extrusion punch, however, is approximately one-half inch longer than the nose 21 of the first extrusion punch. The angle of taper designated by $\alpha$ in FIG. 1, however, is essentially the same for both punches ignoring manufacturing tolerances.

The extrusion blank $A_2$ is annealed and relubricated in the manner described above. It has been found necessary to anneal the blank after each extrusion operation due to the marked reduction in the ductility of the material caused by cold working. Contrary to the predictions of standard literature regarding maraging steels, an increase in hardness of 10–11 points on the Rockwell C scale has been observed. This increase in hardness dictates an anneal prior to each extrusion operation. This relatively large increase in hardness is thought to be primarily due to cold backward extrusion which results in a greater increase in hardness than the cold working processes reported in the current literature. The annealed and relubed extrusion blank $A_2$ is located in the extrusion die 64 as shown in FIG. 3. The ram 18 is then motored down until the extrusion punch 72 seats in the tapered hole formed in the preceding extrusion operation. At this point the shank 76 of the extrusion punch 72 has entered the upper die 28 so that it is guided in the same manner as during the first extrusion operation.

As the ram 18 moves downwardly, the conical end 60 of the extrusion blank $A_2$ begins to enter the die land 66. The extrusion die 64 is designed to produce approximately a 64% reduction in area at the die land 66. It is important to note that due to the high resistance to flow encountered by the extrusion blank $A_2$ at the die land 66, backward extrusion of the metal around the nose 74 of the extrusion punch 72 occurs before any significant forward extrusion. Backward extrusion proceeds until the material encounters the shoulder 77 of the extrusion punch 72. At this point the material has completely filled the free volume in the die cavity. The shoulder 77 of the punch 72 then acts as a pusher to force the blank $A_2$ through the die land 66. The material flows through the die land 66 until it encounters the end of the anvil 70. This forward extrusion forms a cylindrical section 78 on the leading end of the extrusion blank $A_3$ forward of the conical section 60.

It is pointed out that, similar to the first extrusion operation, the second extrusion operation is a combination of forward extrusion and backward extrusion which results in an elongation of the tapered hole and the body of the extrusion blank $A_3$. Unlike the first extrusion operation, however, it is critical that the backward extrusion proceed before forward extrusion in order to fully develop the shape of the extrusion blank $A_3$ defined by the tapered nose 74 of the second extrusion punch 72. After completion of the stroke, the extrusion blank $A_3$ is ejected by a knockout 80 which forces the anvil 70 and the extrusion blank $A_3$ upwardly.

Upon completion of the second cold extrusion operation the overall length of the extrusion blank $A_3$ has been increased to approximately nine inches and the tapered hole is approximately three inches deep.

Figure 5:
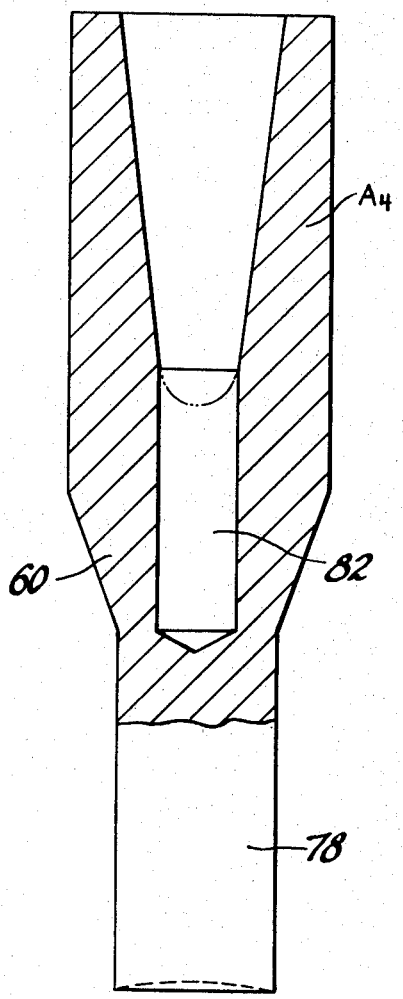
FIG. 5 is a cross-sectional view of an extrusion blank which is the product of the first and second cold extrusion operations and a machining operation.

At this point in the processing, it is necessary to begin fully developing the shape of the tapered hole to the proper dimensions. Since the bottom of the tapered hole must have a diameter less than 0.4 inches, it is difficult to accurately form the bottom portion of the hole by extrusion. This is due to the fact that a punch having the required diameter tends to drift in the material. It has been discovered by the inventor that precise concentricity can be achieved by employing an intermediate machining operation to increase the depth of the tapered hole in preparation for subsequent extrusion operations. Referring to FIG. 5, a straight-sided hole extension 82 is gun-drilled at the bottom of the tapered hole in the extrusion blank $A_3$. The hole 82 is approximately $1\frac{3}{4}$ inches long and has a diameter of approximately 0.525 inches. Gun drilling is employed to machine the hole extension 82 since this is believed to be the most precise drilling procedure available.

After machining the hole extension 82 at the bottom of the tapered hole, the resulting extrusion blank $A_4$ is annealed and relubricated by performing the annealing and lubricating procedures described above.

At this point in the processing the cylindrical section 78 of the extrusion blank $A_4$ is fully formed. Additional cold extrusion operations are performed to further elongate the hole and the blank $A_4$ by forcing the entire blank through a die land. For each additional cold extrusion operation, a longer extrusion punch is employed. Since the extrusion punches used in these operations are long (up to 16 inches) and relatively thin-sectioned, close attention must be paid to the problem of punch breakage. In order to reduce the punch breakage and to maintain the close dimensional accuracy required, a floating punch, rather than a rigidly supported punch, is employed and the walls of the tapered hole are used to support at least a portion of the punch.

Figure 6:
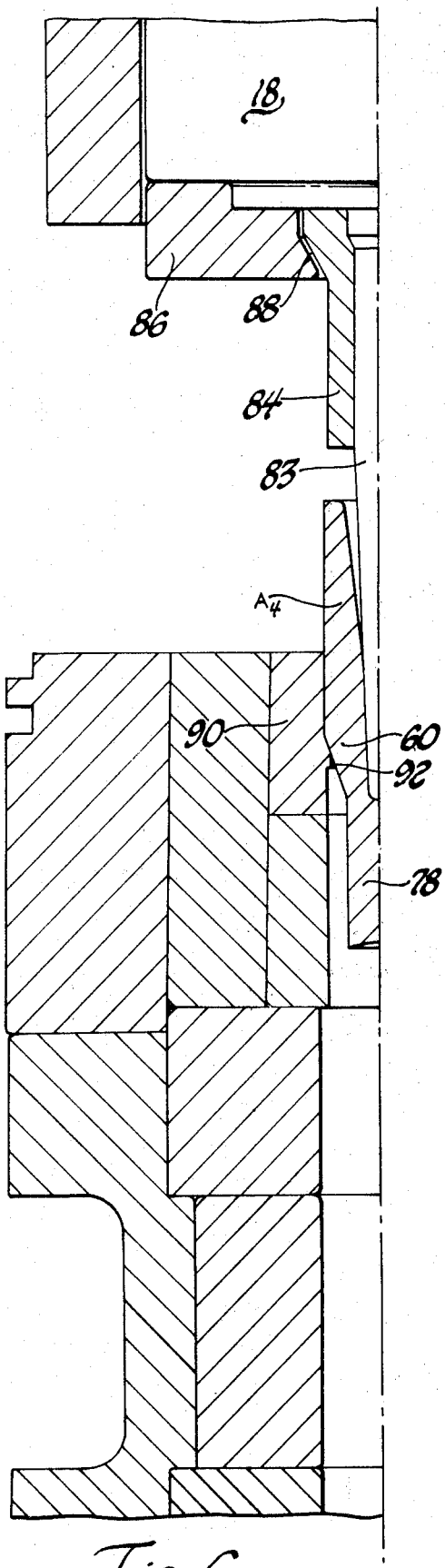
FIG. 6 is a cross-sectional view of an extrusion press and related extrusion tools in accordance with the instant invention for performing a cold extrusion operation on the extrusion blank shown in FIG. 5.
Figure 7:
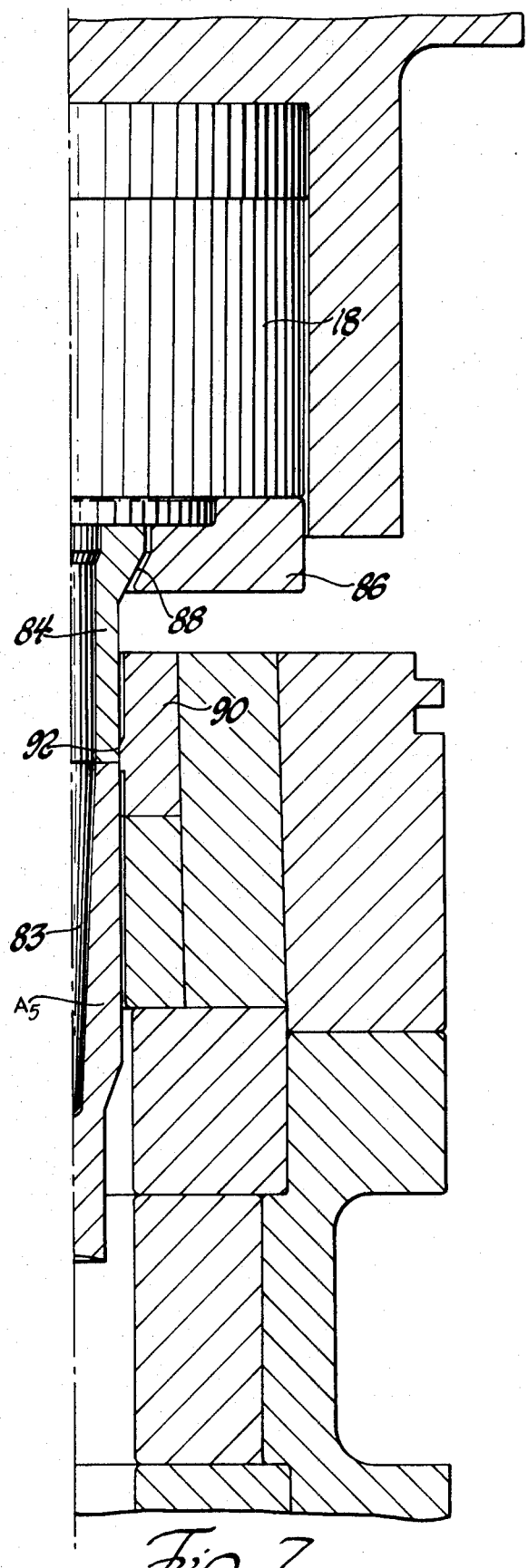
FIG. 7 is a cross-sectional view similar to FIG. 6 showing the moved positions of the various parts after the extrusion operation is completed.
Figure 8:
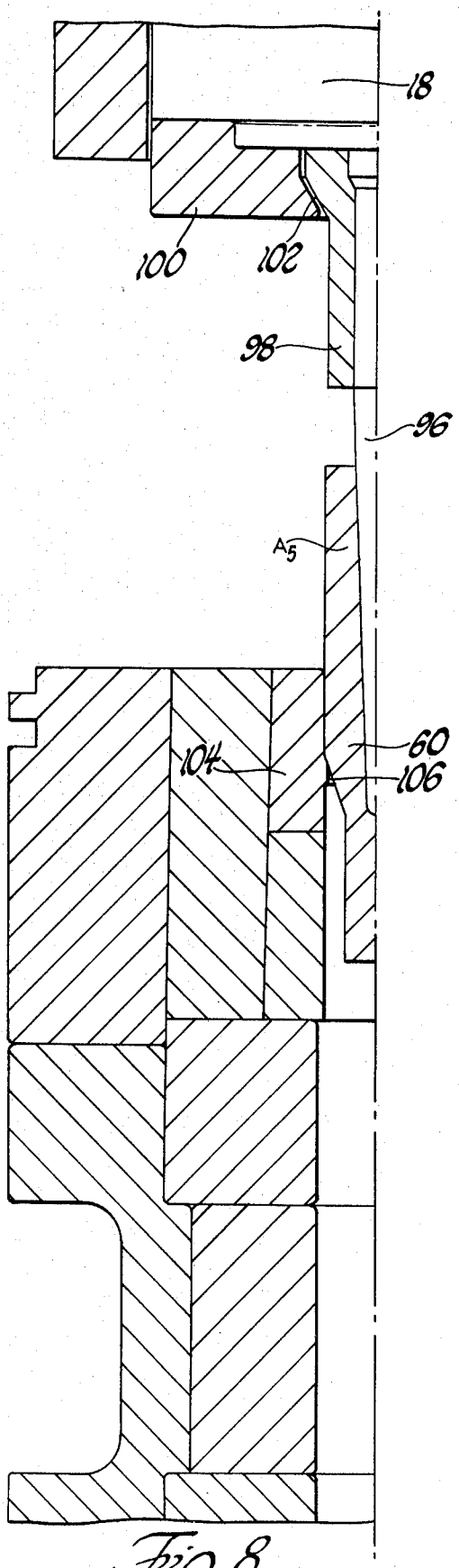
FIG. 8 is a cross-sectional view of an extrusion press and related extrusion tools in accordance with the instant invention for performing a fourth extrusion operation on the extrusion blank, the fourth extrusion operation being typical of subsequent extrusion operations.

FIGS. 6 and 7 show an extrusion press setup for performing the first cold extrusion operation subsequent to the machining step.

A long tapered extrusion punch 83 is employed in combination with an outer punch 84. The outer punch 84 is mounted to the ram 18 by means of a retainer 86. A 0.030 inch clearance 88 is provided between the outer punch 84 and the retainer 86. The clearance 88 causes a self-centering action between the tapered punch 83 and the hole in the extrusion blank $A_4$. For this and subsequent extrusion operations the dimensions of the tapered punch 83 conform exactly to the dimensions of the tapered hole required in the final part. In other words, in the two preliminary cold extrusion operations the angle of taper of the punches and their diameters are not the same as the angle of taper and the diameter of the tapered hole which must be developed in the final part. In the extrusion operations after machining, however, the angle of taper and diameter of the punches are the same as that of the tapered hole in the final part in the extrusion operations shown in FIGS. 6–9.

An extrusion die 90 is employed which includes a die land 92. The dimensions of the extrusion die 90 are such that when the extrusion blank $A_4$ is seated in the die cavity, the cylindrical section 78 passes through the die land 92 and the die land contacts the sides of the conical section 60 near its base to effect approximately a 16% reduction in area. It is also noted that the diameter of the outer punch 84 is slightly smaller than the diameter of the die land 92 so that it can pass through the die land 92 during the working stroke.

As the ram 18 motors down, the tapered punch 83 enters the tapered hole in the extrusion blank $A_4$ and moves down into the drilled hole extension 82. As the end of the tapered punch 83 moves into the drilled hole extension 82 conforms to the taper of the punch 83. Consequently, the lower portion of the tapered punch 83 is supported by the walls of the hole in the extrusion blank $A_4$. Above the drilled hole extension 82 there is significant clearance between the sides of the tapered hole and the punch 83. The clearance is caused by the difference in the taper angle between the punch 83 and the walls of the tapered hole. Due to the fact that the clearance exists, extrusion is facilitated by a reduction in the force necessary to punch the extrusion blank $A_4$ through the extrusion die 90 because the material tends to collapse around the extrusion punch 83.

Figure 10:
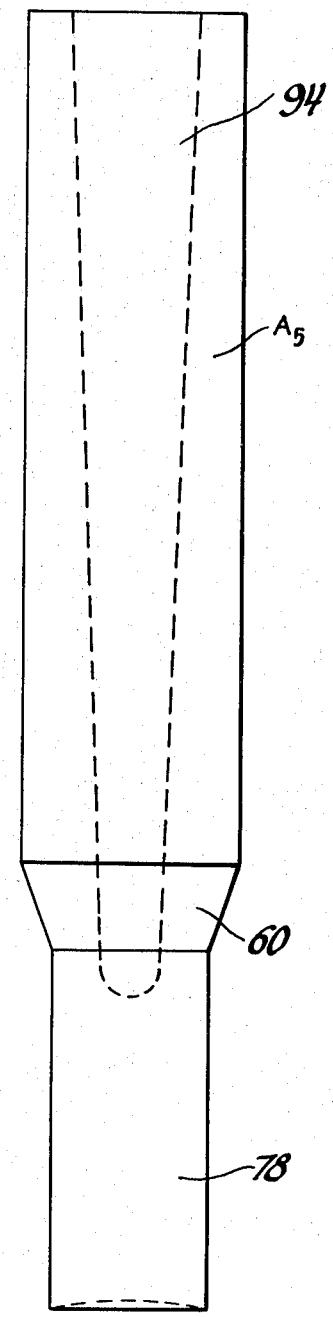
FIG. 10 is a front-elevational view of an extrusion blank which is the product of the cold extrusion operation shown in FIGS. 8 and 9.

Upon initiation of the working stroke there is enough resistance to the passage of the extrusion blank $A_4$ through the die land 92 that the extrusion punch 83 initially penetrates into the material at the base of the hole. This penetration will extend the depth of the hole approximately one quarter of an inch into the cylindrical section 78. The extrusion blank $A_4$ is then forced through the extrusion land 92. As this occurs, the material of the extrusion blank $A_4$ is ironed between the extrusion land 92 and the extrusion punch 83 causing backward extrusion. The working stroke continues until the outer punch 84 enters the extrusion land 92 as shown in FIG. 7. At this point, the extrusion blank $A_5$ drops through the extrusion die 90. This cold extrusion operation is referred to as a draw-wipe operation. The product of the first draw-wipe operation is shown in FIG. 10. It is pointed out that the extrusion blank $A_5$ has a uniformly tapered and concentric hole 94 which extends into the cylindrical section 78. Additionally, the height of the conical section 60 has been reduced as well as the diameter of the body of the extrusion blank $A_5$ as compared to the extrusion blank $A_4$.

The extrusion blank $A_5$ is then prepared for a second draw-wipe operation by annealing and relubricating in the manner described above. The second draw-wipe operation is performed with the extrusion press setup shown in FIGS. 8 and 9. Unlike the first draw-wipe operation, the tapered extrusion punch 96, which is different only in length from the tapered extrusion punch 83 used in the first draw-wipe operation, is in full bearing contact with the walls of the tapered hole in the extrusion blank $A_5$. Like the extrusion punch 83 employed in the first draw-wipe operation, the extrusion punch 96 is employed in combination with an outer punch 98 which is mounted to the ram 18 of the extrusion press by a retainer 100. Again, a 0.030 inch clearance 102 is provided between the outer punch 98 and the retainer 100. An extrusion die 104 is used which is slightly smaller than the extrusion die 90 used in the first draw-wipe operation. The extrusion die 104 includes a die land 106 which engages the sides of the conical section 60 below its base. The extrusion die 104 is dimensioned to effect approximately a 17% reduction in area during the second draw-wipe operation.

Figure 9:
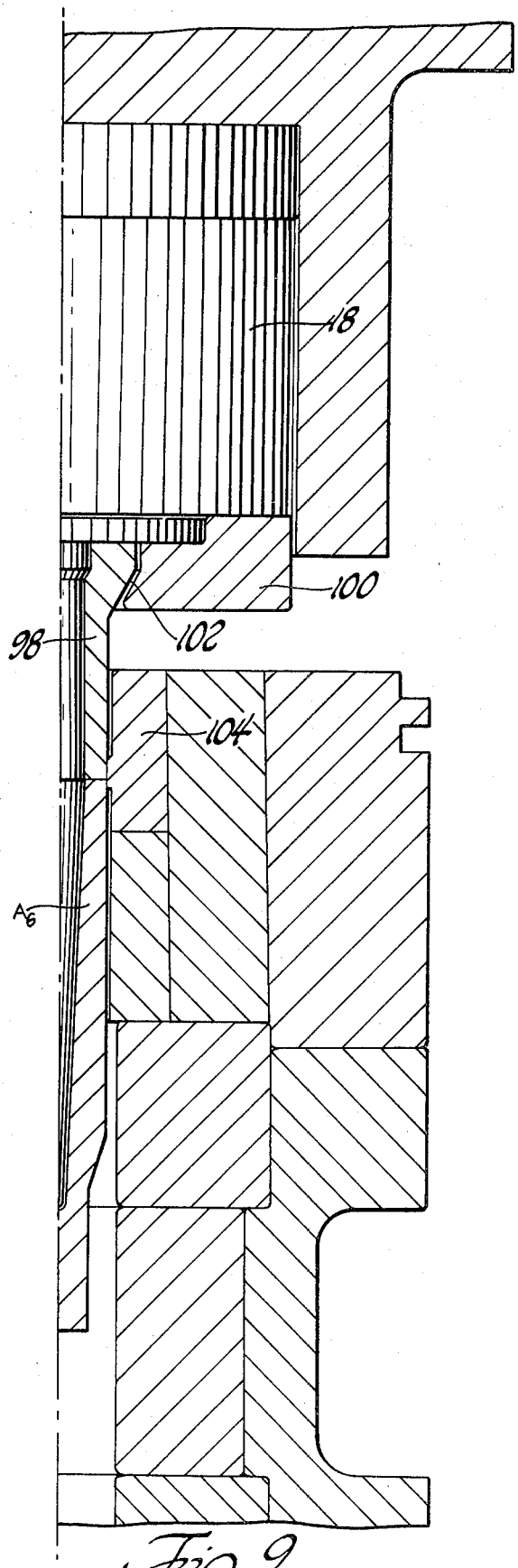
FIG. 9 is a cross-sectional view similar to FIG. 8 showing the moved positions of the various elements after the extrusion operation is completed.

As the working stroke begins, the punch 96 penetrates the material approximately ¼ inch. The extrusion blank $A_5$ is then forced through the extrusion land 106 thereby backward extruding the material. Again, the working stroke proceeds until the outer punch 98 enters the die land 106 as shown in FIG. 9. As this point, the product of the second draw-wipe operation, extrusion blank $A_6$, drops through the die land 106.

The extrusion blank $A_6$ is then prepared for a third draw-wipe operation by annealing and lubricating in the manner described above. The third draw-wipe operation is substantially identical to the second draw-wipe operation, the only difference being that a longer tapered extrusion punch and a smaller extrusion die is employed. The extrusion die in the third draw-wipe operation is dimensioned to effect approximately a 19% reduction in area in the extrusion blank $A_6$. The product of the third draw-wipe operation, extrusion blank $A_7$, is shown in FIG. 11. The extrusion blank $A_7$ has a fully-developed, tapered hole 12 with the precise dimensions required and a surface finish of approximately 10 micro inches. The tapered hole 12 is extremely concentric and accurately dimensioned.

Thereafter, the exterior surface of the extrusion blank $A_7$ is finish machined to form the required external details (not shown). It is noted, however, that significantly less machining is required than when the entire sub projectile blank is machined from bar.

In order to relieve surface stresses which tend to cause stress corrosion crackling, the blank $A_7$ is shot-blasted such that the shot impinges the blank at a 90° angle in a transverse plane. This relieves surface stresses without disturbing the mechanical properties of the part which have been developed by the heavy work occuring during cold extruding.

It has been discovered that the material can be more easily extruded by employing a series of tapered punches wherein the leading end or nose portion of each punch has a smaller taper angle than the trailing end of the punch. These punches are employed after the extrusion blank has been formed by the preliminary forward and backward extrusion operations as, for example, the operations described with respect to FIGS. 1–4.

Figure 12:
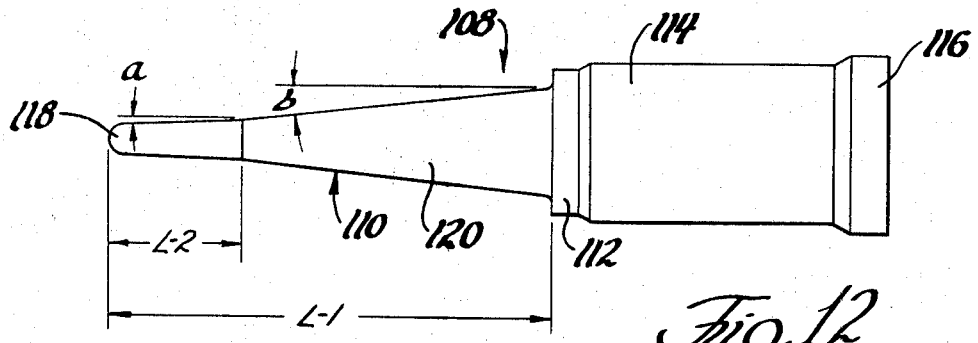
FIGS. 12 through 15 are front elevational views of a modified set of tapered extrusion punches for performing a series of cold extrusion operations on an extrusion blank of the type shown in FIG. 5.

More specifically, an improved set of extrusion punches are shown in FIGS. 12 through 15. These punches are also tapered and are progressively elongated as are the punches used with the extrusion operations described hereinbefore. These punches differ, however, in that all but the last punch (shown in FIG. 15) includes two taper angles. As shown in FIG. 12, the first punch, which is generally shown at 108 includes an elongated tapered portion, generally indicated at 110, which is followed by a cylindrical shoulder 112. The cylindrical shoulder on this punch 108, as well as subsequently described punches, is used as a pusher in lieu of the outer punches 84 and 98 as described with respect to the punch configurations shown in FIGS. 6 through 9. This is an alternate punch design feature and is not critical to the performance of the punch. The shoulder 112 is followed by a punch shank 114 having an enlarged end 116 which is received within a punch retainer for mounting the punch on the ram of an extrusion press.

The tapered portion 110 of the punch 108 has a length L-1 of approximately 5.75 inches. (The dimensions given are merely for the purpose of illustrating the relative sizes of the punches and their proportions and are not critical.) The tapered portion 110 includes a leading section 118 having a rounded end and a taper angle a of 2°15′. The length L-2 of the leading section 118 is approximately 1.75 inches. Following the leading section 118 is a trailing section 120 having a taper angle b of 5°49′, i.e., a taper angle which is larger than the taper angle a of the leading section 118.

The first punch 108, which is also the shortest punch of the set, is employed to perform the first extrusion operation subsequent to the preliminary cold extrusion operations described with reference to FIGS. 1 through 9. The taper angle of the last preliminary cold extrusion punch (FIGS. 3 and 4) is larger than 5°49′ so that the punch 108 can be freely motored down into the tapered hole in the extrusion blank without interfering with the sides of the hole. If the extrusion blank has been gun-drilled as shown in FIG. 5, the leading section 118 will enter the straight sided hole and coin the material so that it will conform to the shape of the leading section 118. At this point, the punch 108 is firmly seated at the bottom of the hole in the extrusion blank.

During extrusion the extrusion blank is forced through an extrusion die in a manner similar to that described with respect to the simple tapered punches. However, the modified punches are dimensioned so that the extrusion blank is extruded off of the punch. In other words, the extrusion blank moves through the extrusion die at a faster rate than the punch due to the pressure exerted on the extrusion blank by the shoulder 112 of the punch 108. Hence, the extrusion blank falls off the punch after is has passed through the extrusion die. During extrusion the walls of the tapered hole are wiped between the die land of the extrusion die and the punch to reduce the thickness of the walls of the extrusion blank and to cold work the material.

The internal dimensions of the resulting extrusion blank are substantially identical to the external dimensions of the tapered portion 110 of the punch 108. That is, the tapered hole includes a lower section having a taper angle of 2°15′ and an upper section having a taper angle of 5°49′. It is noted that the taper angle of the hole in the finished part is 2°15′ from end to end. Therefore, the length of the lower section must be progressively elongated until the desired taper angle is achieved over the entire length of the tapered hole. Hence, the final punch (shown in FIG. 15) includes a taper angle of 2°15′ over its entire length. This configuration is developed by the intermediate punches described below.

Figure 13:
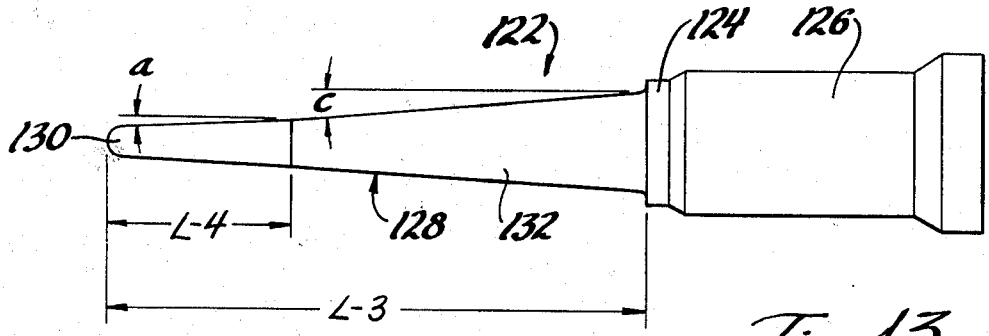

After the extrusion blank is annealed and lubricated, it is subjected to an extrusion operation using a second punch generally shown at 122 in FIG. 13. The second extrusion punch 122 is longer than the first extrusion punch 108 and has a shoulder 124 and shank 126 of smaller diameter. The length L-3 of the tapered portion generally indicated at 128 is approximately 7.00 inches. The tapered portion 128 includes a leading section 130 having a taper angle a of 2°15′. The leading section 130 of the second punch has a length L-4 which is longer than the length L-2 of the leading section of the first punch 108, i.e., 2.50 inches.

In order to prevent interference between the punch and the interior of the tapered hole, the trailing section 132 has a taper angle c of 4°0′ which is less than the taper angle of the upper section of the hole, i.e., 5°49′. Reducing the taper angle of the trailing section 132 also results in bringing the taper angle of the hole closer to the desired angle, i.e., 2°15′. When the second punch 122 is motored down into the hole, the first 1.75 inches of the leading section 130 will seat snugly into the lower section of the hole while the remainder of the punch will be slightly clear of the sides of the hole.

Cold extrusion of the extrusion blank through the extrusion die proceeds as described above with respect to the first punch 100. Specifically, the extrusion blank is extruded off the end of the punch 122 and the walls of the hole are further cold worked during elongation. After extrusion the internal dimensions of the hole are substantially the same as the external dimension of the punch 122.

It is noted that, throughout, the extrusion operations cause metal flow along the length of the extrusion blank thus producing directional deformation parallel to the longitudinal axis of the extrusion blank. This improves the physical properties of the resulting part and increases its penetrating ability.

Figure 14:
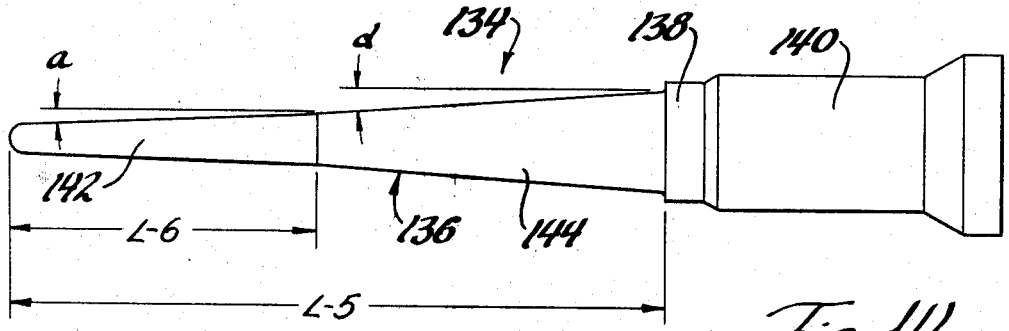

After annealing and lubricating, the extrusion blank is further elongated and cold worked by means of a third extrusion punch generally shown at 134 in FIG. 14. Again, the length L-5 of the tapered portion generally indicated at 136 is increased, in this case to 8.50 inches. The diameter of the shoulder 138 and the shank 140 are reduced. The length L-6 of the leading section 142, which has the taper angle of a 2°15′, is increased to 4.00 inches. In order to avoid interference and to bring the taper angle closer to 2°15′, the taper angle d of the trailing section 144 is reduced to 3°31′. Again, cold extrusion of the extrusion blank proceeds in the manner described above. During cold extrusion the tapered hole is again elongated and the length of the lower section of the hole having the desired final taper angle is also elongated. The walls of the extrusion blank also undergo further cold working.

Figure 15:
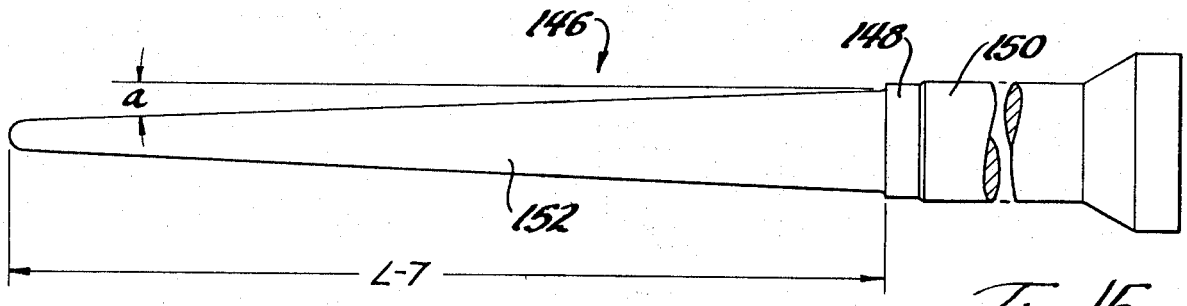

After another anneal and lubrication cycle the extrusion blank is extruded using the fourth, and final, extrusion punch generally shown at 146 in FIG. 15. The final extrusion punch 146 brings the extrusion blank to the final dimensions desired from the extrusion process.

The shoulder 148 and shank 150 of the punch 146 are further reduced in diameter and the length L-7 of the tapered portion 152 is increased to 11.00 inches, the desired final length of the tapered hole. In the final punch the entire length L-7 of the tapered portion 152 has a taper angle a of 2°15′. After extrusion, the extrusion blank will include a tapered hole having a length of approximately 11.00 inches and a constant taper angle of 2°15′ from end to end.

By way of summary, the following table indicates the dimensions of the four punches described above. (L.=length; T.A.=taper angle) Again it is pointed out that the specific dimensions are those employed for producing a particular part to predetermined specifications and are merely exemplary and critical.

| | OVERALL | LEADING SECTION | | TRAILING SECTION |
|---|---|---|---|---|
| | LENGTH | L. | T.A. | T.A. |
| 1st punch | 5.75″ | 1.75″ | 2°15′ | 5°49′ |
| 2nd punch | 7.00″ | 2.50″ | 2°15′ | 4°0′ |
| 3rd punch | 8.50″ | 4.00″ | 2°15′ | 3°31′ |
| Last punch | 11.00″ | 11.00″ | 2°15′ | — |

As should be apparent from the foregoing, a series, or set, of punches are employed to develop an elongated, precisely dimensioned, tapered hole in a material which is generally considered impossible to cold extrude. As shown in the table the set of punches includes a first punch having a tapered portion comprising a leading tapered section and a trailing tapered section wherein the leading tapered section has a taper angle smaller than the taper angle of the trailing section. The set of punches also includes a final punch having a tapered portion longer than the tapered portion of the first punch and a constant taper angle from end to end closely corresponding to the taper angle of the leading section of the first punch. The set of punches includes at least one intermediate punch comprising a tapered portion having a length longer than the length of the tapered portion of the first punch, but shorter than that of the final punch. Moreover, the intermediate punch includes a leading tapered section and a trailing tapered section wherein the taper angle of the leading tapered section closely corresponds to the taper angle of the leading tapered section of the first punch, but wherein the length of the leading trailing section is increased. In other words, the length of the entire tapered portion and the length of the leading tapered section are progressively increased until the final desired dimensions are achieved. Moreover, the proportional length of the leading tapered section also increases with respect to the overall length of the tapered portion.

Additionally, the taper angle of the trailing tapered section of each successive punch can be decreased until it equals the taper angle of the leading tapered section, i.e., the final taper angle of the tapered hole.

In summary, the invention provides a method for successfully cold extruding 18% nickel maraging steel by impact extrusion to produce a sub projectile blank which is superior to sub projectile blanks produced by machining. While the invention has been described with respect to 18% nickel maraging steel and a specific end product, it is noted that the concepts disclosed herein are applicable to other end products having similar shapes as well as other difficult to extrude materials.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A method of cold extruding annealed maraging steel containing at least about 18% nickel to form an article of manufacture comprising the steps of providing a blank of maraging steel and performing a series of cold extrusion operations on the blank with a punch having an elongated nose tapered over its entire length and terminating in a rounded end to produce a combination forward extrusion and backward extrusion of the blank to form a tapered hole in the blank on the first cold extrusion operation and to also elongate the blank and to thereafter progressively elongate the blank and the tapered hole during subsequent cold extrusion operations, elongation of the tapered hole being accomplished at least in part by backward extrusion of the blank around the punch and wherein at least some of said cold extrusion operations are followed by an annealing cycle and a lubrication procedure.

2. The method set forth in claim 1 wherein elongation of the blank and the tapered hole during subsequent cold extrusion operations is further characterized by performing said subsequent cold extrusion operations with a series of punches comprising a first punch including a tapered portion having a leading tapered section with a taper angle a and a trailing tapered section having a taper angle larger than the taper angle a of said leading tapered section; a final punch including a tapered portion having a length greater than the length of the tapered portion of said first punch and a constant taper angle from end to end which is approximately equal to the taper angle a of the leading tapered section of said first punch; and at least one intermediate punch including a tapered portion having a length greater than that of said first punch and smaller than that of said final punch, a leading tapered section having a taper angle approximately equal to taper angle a and a length greater than the length of the leading tapered section of said first punch, and a trailing tapered section having a taper angle larger than taper angle a.

3. The method as set forth in claim 2 wherein the series of punches is further characterized in that the taper angle of the trailing tapered section of said intermediate punch is less than the taper angle of the trailing section of said first punch.

4. A method of cold extruding annealed maraging steel containing at least about 18% nickel, to form an article of manufacture comprising the steps of performing at least a preliminary cold extrusion operation on an extrusion blank with a first punch having an elongated nose tapered over its entire length and terminating in a rounded end while partially restraining the blank to produce a combination forward extrusion and backward extrusion of the blank to form a tapered hole in the blank and to elongate the blank, and performing at least one additional cold extrusion operation to further elongate the hole and the blank by forcing the entire blank through a die with a floating tapered punch which, when seated in the hole of the blank prior to extrusion, is supported along a portion of its length by the walls of the hole and wherein at least some of said cold extrusion operation are followed by an annealing cycle and a lubrication procedure.

5. The method as set forth in claim 4 wherein each preliminary cold extrusion operation further includes rigidly supporting the tapered punch and guiding the shank of the tapered punch in the die cavity over the entire working stroke of the punch.

6. The method as set forth in claim 4 including a first preliminary cold extrusion operation comprising cold extruding the blank with a first tapered punch to form a conical section on the leading end of the blank by forward extrusion and the tapered hole by backward extrusion.

7. The method as set forth in claim 6 wherein the first preliminary cold extrusion operation is further defined as producing a cold worked condition in the walls of the blank characterized by a reduction in area which increases from about 15% at the bottom of the tapered hole to about 60% at the top of the tapered hole.

8. The method as set forth in claim 6 including a second preliminary cold extrusion operation comprising cold extruding the blank by forcing the leading end of the blank through a die with a tapered punch having a length greater than that of the first tapered punch to form a cylindrical section on the leading end of the blank forward of the conical section by forward extrusion and to elongate the tapered hole by backward extrusion wherein the die is dimensioned to produce a reduction in area of sufficient magnitude such that backward extrusion is completed before forward extrusion begins.

9. The method as set forth in claim 8 wherein the second preliminary cold extrusion operation is further defined as producing at least about a 60% reduction in area in the cylindrical section of the blank.

10. The method as set forth in claim 8 wherein each preliminary cold extrusion operation further includes rigidly supporting the tapered punch and guiding the shank of the tapered punch in the die cavity over the entire working stroke of the punch.

11. The method as set forth in claim 4 wherein elongation of the blank and the hole is further characterized by performing a series of additional cold extrusion operations with a set of punches comprising a first punch including a tapered portion having a leading tapered section with a taper angle a and a trailing tapered section having a taper angle larger than the taper angle a of said leading tapered section; a final punch including a tapered portion having a length greater than the length of the tapered portion of said first punch and a constant taper angle from end to end which is approximately equal to the taper angle a of the leading tapered section of said first punch; and at least one intermediate punch including a tapered portion having a length greater than that of said first punch and smaller than that of said final punch, a leading tapered section having a taper angle approximately equal to the taper angle and a length greater than the length of the leading tapered section of said first punch, and a trailing tapered section having a taper angle larger than the taper angle a.

12. The method as set forth in claim 10 wherein the set of punches is further characterized in that the taper angle of the trailing tapered section of said intermediate punch is less than the taper angle of the trailing section of said first punch.

13. A method of cold extruding annealed maraging steel containing at least about 18% nickel to form an article of manufacture comprising the steps of performing a first cold extrusion operation on an extrusion blank with a first punch having an elongated nose tapered over its entire length and terminating in a rounded end while partially restraining the blank to produce a combination forward extrusion and backward extrusion of the blank to form a tapered hole in the blank and a conical section on the leading end of the blank, performing a second cold extrusion operation on the blank by forcing the leading end of the blank through a die with a second tapered punch having similar geometry but being of greater length than that of said first punch to produce a combination forward extrusion and backward extrusion of the blank to form a cylindrical section on the leading end of the blank forward of the conical section to elongate the tapered hole wherein the die produces a reduction in area of sufficient magnitude to cause backward extrusion of the blank before forward extrusion begins, and performing at least one additional extrusion operation to further elongate the hole and the blank by forcing the entire blank through a die having a diameter greater than the diameter of the cylindrical section and less than the largest diameter of the conical section with a floating tapered punch having a geometry similar to that of said first and second punches which, when seated in the hole of the blank prior to extrusion, is supported at least at its leading end by the walls of the hole and wherein at least some of said cold extrusion operations are followed by an annealing cycle and a lubrication procedure.

14. The method as set forth in claim 13 wherein the first and second extrusion operations further include the step of guiding the shank of the punch in the die cavity over the entire working stroke of the punch.

15. A method for producing an article of manufacture from annealed 18% nickel maraging steel having an elongated, generally cylindrical body and a tapered hole within the body by cold extrusion comprising the steps of performing at least one preliminary cold extrusion operation on a cylindrical extrusion blank using an extrusion punch in combination with an extrusion die wherein the extrusion punch includes an elongated nose tapered over its entire length and terminating in a rounded end nose wherein the taper angle is greater than the taper angle of the hole to be formed and the length of said nose is less than the length of the hole to be formed and the extrusion die includes means for partially restraining the extrusion blank to produce a combination of forward extrusion and backward extrusion of the blank to form a tapered hole in the blank and to elongate the blank and performing at least one additional cold extrusion operation to further elongate the tapered hole formed in the preliminary cold extrusion operation and the blank and to change the taper angle of the hole by forcing the entire extrusion blank through an extrusion die with an extrusion punch wherein the extrusion punch includes a tapered nose having a taper angle substantially corresponding to the taper angle of the hole to be formed and wherein at least some of said cold extrusion operations are followed by an annealing cycle and a lubrication procedure.

16. The method set forth in claim 15 wherein the preliminary cold extrusion operations are performed with an extrusion punch having an elongated cylindrical shank and an extrusion die having a die cavity of sufficient depth and suitable diameter to receive and guide the shank of the extrusion punch throughout the working stroke of the extrusion punch.

17. The method set forth in claim 16 including a first preliminary cold extrusion operation using a first extrusion die having an upper cylindrical section and a lower tapered section wherein the extrusion blank is fully received in the upper cylindrical section and is forward extruded into the tapered section to form a conical section on the leading end thereof.

18. The method set forth in claim 17 including a second preliminary cold extrusion operation using a second extrusion die having dimensions substantially indentical to those of the first extrusion die and an annular die land below the tapered section wherein the extrusion blank is partially forward extruded through the die land to form a cylindrical section on the blank forward of the conical section, the reduction in area caused by the die land being of sufficient magnitude to force backward extrusion of the blank around the tapered punch before forward extrusion begins.

19. The method set forth in claim 15 wherein the additional cold extrusion operations are performed with an extrusion punch which is at least partially supported by the walls of the hole in the extrusion blank.

20. The method set forth in claim 19 wherein the additional cold extrusion operations are performed with a self-centering, floating punch.

* * * * *